US006619928B2

(12) United States Patent
Konishi

(10) Patent No.: US 6,619,928 B2
(45) Date of Patent: Sep. 16, 2003

(54) VARIABLE DISPLACEMENT PUMP

(75) Inventor: Hideo Konishi, Saitama (JP)

(73) Assignee: Unisia JKC Steering Systems Co., Ltd., Kanagawa (JP)

( * ) Notice: Subject to any disclaimer, the term of this patent is extended or adjusted under 35 U.S.C. 154(b) by 0 days.

(21) Appl. No.: 10/006,139

(22) Filed: Dec. 10, 2001

(65) Prior Publication Data

US 2002/0085923 A1 Jul. 4, 2002

(30) Foreign Application Priority Data

Dec. 15, 2000 (JP) ..... P. 2000-381854

(51) Int. Cl.[7] ..... F04B 49/00
(52) U.S. Cl. ..... 417/213; 417/307
(58) Field of Search ..... 417/212, 213, 417/214, 220, 221, 299, 300, 307, 310, 222.1, 222.2, 218, 219

(56) References Cited

U.S. PATENT DOCUMENTS

| | | | | | |
|---|---|---|---|---|---|
| 4,072,443 | A | * | 2/1978 | Heath | 417/218 |
| 4,311,161 | A | * | 1/1982 | Narumi et al. | 137/117 |
| 4,468,173 | A | * | 8/1984 | Dantlgraber | 417/220 |
| 4,637,782 | A | * | 1/1987 | Teubler et al. | 417/300 |
| 4,681,517 | A | * | 7/1987 | Schulz et al. | 417/300 |
| 5,518,380 | A | * | 5/1996 | Fujii et al. | 418/26 |
| 5,562,432 | A | * | 10/1996 | Semba et al. | 418/26 |
| 5,876,185 | A | * | 3/1999 | Schimpf et al. | 417/213 |
| 6,213,730 | B1 | * | 4/2001 | Yasuda et al. | 417/307 |
| 6,227,816 | B1 | * | 5/2001 | Breuer et al. | 417/310 |

FOREIGN PATENT DOCUMENTS

| | | | |
|---|---|---|---|
| DE | 199 42 466 A1 | | 3/2000 |
| DE | 101 20 252 A1 | | 1/2002 |
| JP | 6-200883 | | 7/1994 |
| JP | 7-243385 | | 9/1995 |
| JP | 8-200239 | | 8/1996 |
| JP | 10 67332 | * | 3/1998 |

OTHER PUBLICATIONS

Patent Abstract of Japan, 06–200883, Jul. 19, 1994.

Patent Abstract of Japan, 07–243385, Sep.19, 1995.

Patent Abstract of Japan, 08–200239, Aug. 6, 1996.

* cited by examiner

*Primary Examiner*—Charles G. Freay
*Assistant Examiner*—Han Lieh Liu
(74) *Attorney, Agent, or Firm*—Sughrue Mion, PLLC

(57) ABSTRACT

A cam ring 10 is slidably supported within a pump body 2, and a rotor 20 is rotatably disposed inside the cam ring. The cam ring is eccentric to a rotation shaft 22 of the rotor. The rotor carries a plurality of vanes 18 that can be advanced or retreated, in which a pump chamber 24 is formed in a space between the cam ring and the rotor. The cam ring is formed with the first and second fluid pressure chambers 14 and 16 on both sides thereof, and biased in a direction where the displacement of the pump chamber is at maximum by a spring 26. A control valve 28 is provided in which a differential pressure across a metering orifice is applied on both ends of a spool 32 and a spring 36 is disposed on the side of an end face where a downstream fluid pressure is applied. The fluid pressures of the fluid pressure chambers 14 and 16 are controlled by means of the control valve, whereby the cam ring is swung. A piston 58 that is moved in accordance with an increase in working pressure of a power steering apparatus is provided. This piston 58 exerts an axial thrust to an end face of the spool on the spring side.

7 Claims, 6 Drawing Sheets

VARIABLE DISPLACEMENT PUMP

BACKGROUND OF THE INVENTION

1. Field of the Invention

The present invention relates to a variable displacement pump used in a pressure fluid utilization equipment such as a power steering apparatus for reducing a handle operating force of a vehicle.

2. Description of the Related Art

For example, a fluid pressure pump for use with a power steering apparatus is required to supply a full amount of pressure fluid to a power cylinder of a power steering apparatus to obtain a steering auxiliary force corresponding to a steering condition, when performing steering operation of a steering wheel (a so-called steering time). On the other hand, during the non-steering such as while the vehicle is running straight, supply of the pressure fluid is practically unnecessary. Also, the pump for the power steering apparatus is required to reduce the amount of supplying the pressure fluid while running at high speed below that at stoppage or while running at low speed, whereby it is desired to offer some stiffness to the steering wheel while running at high speed, and secure the driving stability while running straight at high speed.

Conventionally, the pump for the power steering apparatus of this kind is typically a displacement pump having an engine of the vehicle as a driving source. The displacement pump has a characteristic that the discharge flow is increased with greater number of rotations of the engine. Accordingly, when the displacement pump is employed as the pump for the power steering apparatus, a flow control valve is needed to control the discharge flow from the pump below a predetermined amount, irrespective of the number of rotations. However, with the displacement pump with the flow control valve, even if the pressure fluid is partially flowed back via the flow control valve to a tank, the load on the engine is not decreased, with an equal driving horse power of the pump, whereby the energy saving effect could not be obtained.

To resolve such a drawback, a variable displacement vane pump is conventionally proposed in which the discharge flow (cc/rev) per revolution of the pump can be decreased in proportion to an increase in the number of rotations, as described in JP-A-6-200883, JP-A-7-243385, and JP-A-8-200239. These variable displacement pumps are a so-called engine rotation number sensitive pump, in which if the engine rotation number (pump rotation number) is increased, the cam ring is moved in a direction where the pump displacement of the pump chamber is decreased, corresponding to the magnitude of a fluid pressure on the pump discharge side, so that the flow on the pump discharge side can be decreased.

The above variable displacement pump can increase the flow on the pump discharge side relatively when the engine rotation number is small at the stoppage or even while the vehicle is running at low speed, whereby the vehicle can gain a large steering auxiliary force in steering while the vehicle is stopped or running at low speed, and the driver can perform light steering. Also, while the vehicle is running at high speed, the engine rotation number is large, and the flow on the pump discharge side is relatively small, whereby the steering can be effected with an appropriate stiffness on the steering operation force while running at high speed.

Also, the variable displacement pump of this kind may supply a predetermined flow of pressure fluid at the time of steering (or when the steering is required) to obtain a predetermined steering auxiliary force, and the flow of pressure fluid as little as almost zero or the minimum as required during the non-steering (or while no steering is required), which is desired from the viewpoint of energy saving. For example, in a case where the variable displacement pump is directly driven by the engine of the vehicle, the discharge amount from the pump is unnecessary during the non-steering even when the engine rotation number is great. Then, by decreasing the pump discharge amount, the driving horse power of the pump can be suppressed, which respect should be desirably taken into consideration.

That is, in controlling the variable displacement pump of this kind, it is desired that the optimal pump control is performed by determining whether the vehicle is stopped, or running at low speed, medium speed or high speed, and whether the steering is made or not, and depending on the running condition of the vehicle. Accordingly, some measures must be taken in view of the operating condition of the pump and the running condition of the vehicle, so that the vehicle can exhibit the performance as the power steering apparatus by securely grasping the running condition and steering condition of the vehicle and appropriately making the pump control, and attain the energy saving effect as the variable displacement pump by making the driving control of the pump in a required condition.

SUMMARY OF THE INVENTION

The present invention has been achieved to solve the above-mentioned problems, and it is an object of the invention to provide a variable displacement pump in which while the vehicle is running straight, the pump discharge flow can be suppressed low, thereby improving the energy saving effect, and if it is needed to have a large flow at the time of steering, the variable displacement pump can respond quickly and increase the pump discharge flow to produce a required steering auxiliary force.

In order to accomplish the above object, according to a first aspect of the invention, there is provided a variable displacement pump comprising a cam ring supported slidably in an inner space of a pump body, a rotor disposed rotatably within the cam ring, a first fluid pressure chamber formed on one side of the cam ring, a second fluid pressure chamber formed on the other side thereof, biasing means for biasing the cam ring in a direction where the pump displacement of a pump chamber is at maximum, a metering orifice provided halfway on a discharge passage for supplying a pressure fluid discharged from the pump chamber to the pressure fluid utilization equipment, and a control valve for applying an upstream fluid pressure and a downstream fluid pressure of the metering orifice on both end faces of a spool, with a spring disposed on the side of an end face on which the downstream fluid pressure is applied, wherein the cam ring is swung by controlling at least one fluid pressure of the fluid pressure chamber through the activation of the control valve, characterized in that a piston that is moved with an increase in working pressure of the pressure fluid utilization equipment is provided to apply an axial thrust to an end face of the spool on the spring side.

According to a second aspect of the invention, there is provided the variable displacement pump, characterized in that the piston is a stepped piston disposed on the opposite side of the spool, with the spring interposed, one end of the spring contacted with a small diameter end of the piston, a working pressure of the pressure fluid utilization equipment applied on a large diameter end of the piston, whereby an axial thrust is applied via the spring to the spool of the control valve by introducing a lower pressure than the downstream fluid pressure of the metering orifice into a space formed around a step portion between a small diameter portion and a large diameter portion of the piston, and moving the piston by the use of a working pressure of the fluid pressure utilization equipment.

According to a third aspect of the invention, there is provided the variable displacement pump, characterized in that a second spring is disposed around the outer periphery of the spring, one end of the second spring being contacted with an end face of the spool, and the other end being contacted with an end face of a valve bore.

According to a fourth aspect of the invention, there is provided the variable displacement pump, characterized in that the piston is a stepped piston disposed on the opposite side of the spool, with the spring interposed, a working pressure of the pressure fluid utilization equipment applied on a large diameter end of the piston, a small diameter end extended to the spool side, wherein when the piston is moved by the use of a working pressure of the fluid pressure utilization equipment, an axial thrust is applied with a small diameter end of the piston directly contacted with the spool.

According to a fifth aspect of the invention, there is provided the variable displacement pump, characterized in that a change-over valve is provided halfway on an introduction passage for introducing a working pressure of the fluid pressure utilization equipment to a large diameter end of the piston, and when the working pressure is increased above a predetermined value, the change-over valve shuts off the introduction passage.

DETAILED DESCRIPTION OF THE PRESENT INVENTION

Figure 1:
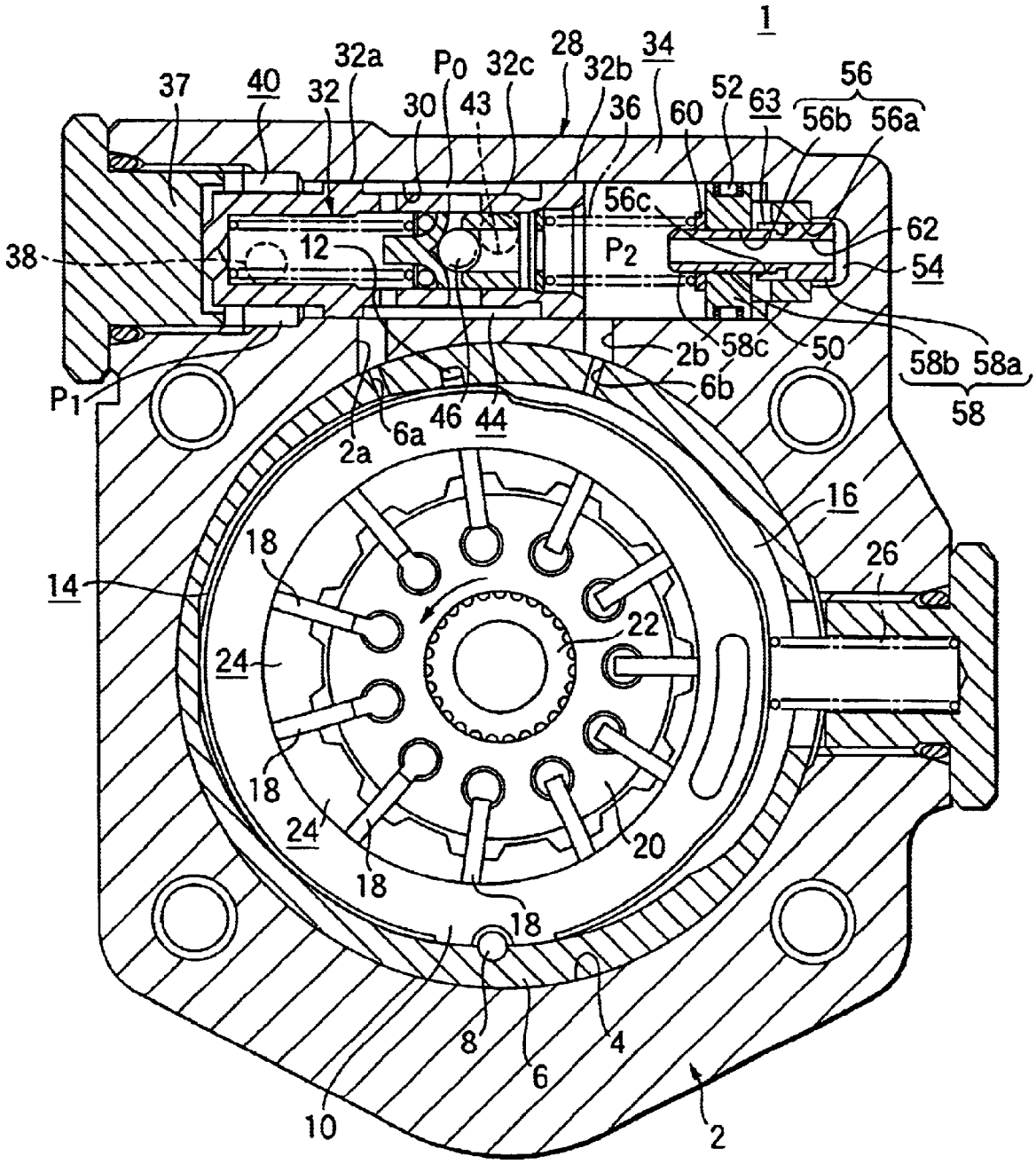
FIG. 1 is a longitudinal cross-sectional view showing the overall constitution of a variable displacement pump according to one embodiment of the present invention.
Figure 2:
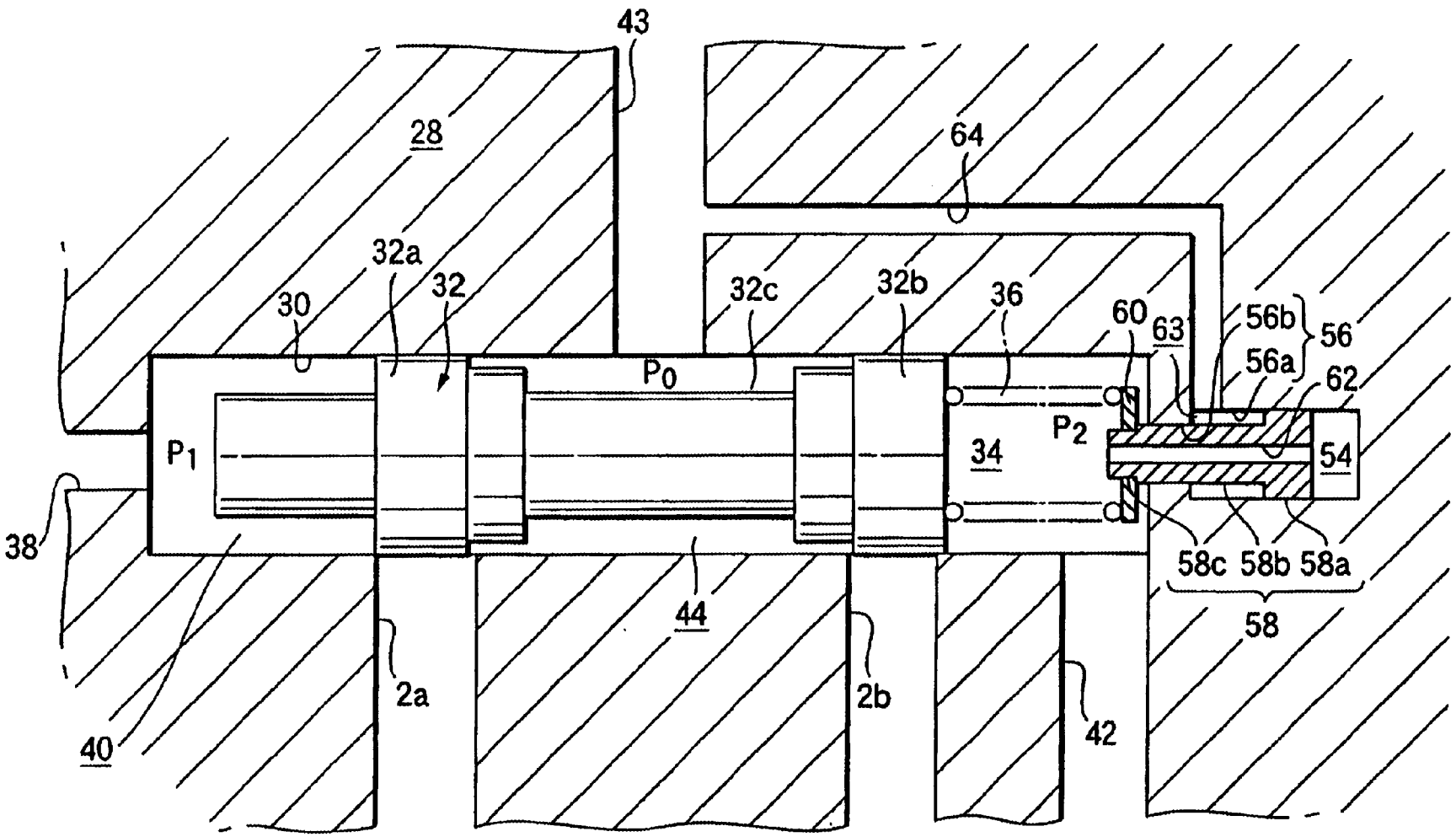
FIG. 2 is a schematic structure view showing a control valve of the variable displacement pump in simplified form.

The preferred embodiments of the present invention will be described below with reference to the accompanying drawings. FIG. 1 is across-sectional view showing the overall constitution of a variable displacement pump according to one embodiment of the invention. FIG. 2 is a schematic constitutional view showing the structure of a control valve provided on the variable displacement pump. This variable displacement pump (denoted at reference numeral 1 as a whole) is an oil hydraulic pump of the vane type that is a hydraulic generator of the power steering apparatus, to which this invention is applied.

Within a pump body 2 having a front body and a rear body abutted, there is formed an accommodation space 4 for accommodating the pump components as a pump cartridge as will be described later, and an adapter ring 6 is fitted on an inner face of the accommodation space 4. A cam ring 10 is swingably disposed via a swinging fulcrum pin 8 in an almost elliptical space of this adapter ring 6. A seal member 12 is provided at a position of this cam ring 10 in almost axial symmetry to the swinging fulcrum pin 8, whereby a first fluid pressure chamber 14 and a second fluid pressure chamber 16 are formed on the both sides of the cam ring 10 by the swinging fulcrum pin 8 and the seal member 12.

Moreover, a rotor 20 that carries a plurality of vanes 18 radially slidably is disposed on an inner peripheral side of the cam ring 10. This rotor 20 is connected to a drive shaft 22 supported rotatably through the pump body 2, and is rotated in a direction of the arrow as indicated in FIG. 1 by the drive shaft 22 that is rotated by an engine, not shown. The cam ring 10 is arranged in an eccentric state to the rotor 20 connected to the drive shaft 22, and a pump chamber 24 is formed by two adjacent vanes 18 in a space formed by the cam ring 10 and the rotor 20. This cam ring 10 is swung around a fulcrum of the swinging fulcrum pin 8 to increase or decrease the volume of the pump chamber 24.

A compression spring 26 is disposed on the side of the second fluid pressure chamber 16 in the pump body 2, thereby biasing the cam ring 10 toward the first fluid pressure chamber 14, namely, in a direction where the volume of the pump chamber 24 is at maximum.

As conventionally well known, the adapter ring 6, the cam ring 10 and the rotor 20 are carried on both sides by a pressure plate, not shown, and a side plate (or a rear body fulfilling the function of the side plate) in the accommodation space 4 inside the pump body 2.

A suction-side opening is formed on a lateral face of the side plate in an area (an upper portion of FIG. 1) where the volume of the pump chamber 24 between two adjacent vanes 18 is gradually increased along with the rotation of the rotor 20, and is used to supply the working fluid sucked via a suction port, not shown, from the tank to the pump chamber 24. Also, a discharge-side opening is formed on a lateral face of the pressure plate in an area (a lower portion of FIG. 1) where the volume of the pump chamber 24 is gradually decreased along with the rotation of the rotor 20, and is used to introduce the pressure fluid discharged from the pump chamber 24 to a discharge-side pressure chamber formed on the bottom of the pump body 2. This discharge-side pressure chamber is connected via a pump discharge-side passage formed in the pump body 2 to a discharge port, whereby the pressure fluid introduced into the discharge-side pressure chamber is delivered from the discharge portion to the power cylinder of the power steering apparatus.

A control valve 28 is disposed orthogonally to the drive shaft 22 within the pump body 2. This control valve 28 has a spool 32 fitted slidably in a valve bore 30 formed in the pump body 2. This spool 32 is always biased to the left (toward the first fluid pressure chamber 14) of FIG. 1 by a spring 36 disposed within a chamber 34 (hereinafter referred to as a spring chamber) at one end (of the second fluid pressure chamber 16 to the right in FIG. 1), and stopped against a front face of a plug 37 fitted into and enclosing an opening portion of the valve bore 30 when in a non-active state.

A metering orifice (not shown) is provided halfway on the discharge-side passage leading from the pump chamber 24 to the fluid pressure utilization equipment (power steering apparatus in this embodiment), in which a fluid pressure upstream of this metering orifice is introduced via a pilot pressure passage 38 into a chamber 40 (hereinafter referred to as a high pressure chamber) to the left in FIG. 1, while a fluid pressure downstream of the metering orifice is introduced via a pilot passage 42 (see FIG. 2) into the spring chamber 34, whereby if a pressure difference between both the chambers 34 and 40 is beyond a predetermined value, the spool 32 is moved against the spring 36 to the right in the figure. The metering orifice is composed of a variable orifice, not shown, having a passage bore with an opening area increased or decreased by swinging of the cam ring 10, and a fixed orifice defining the minimum flow.

The first fluid pressure chamber 14 formed to the left of the cam ring 10 communicates via the connection passages 2*a* and 6*a* formed in the pump body 2 and the adapter ring 6 with the high pressure chamber 40 of the valve bore 30, and the second fluid pressure chamber 16 formed to the right of the cam ring 10 communicates via the connection passages 2*b* and 6*b* formed in the pump body 2 and the adapter ring 6 with the spring chamber 34 of the valve bore 30.

A first land portion 32*a* demarcating the high pressure chamber 40 and a second land portion 32*b* demarcating the spring chamber 34 are formed on the outer peripheral face of the spool 32, and an annular groove portion 32*c* is provided intermediately between both the lands 32*a* and 32*b*. This intermediate annular groove portion 32*c* is connected via a pump suction-side passage 43 to the tank, and a space between this annular groove portion 32*c* and the inner peripheral face of the valve bore 30 makes up a pump suction-side chamber 44.

The first fluid pressure chamber 14 provided to the left of the cam ring 10 is connected via the connection passages 2*a* and 6*a* to a pump suction-side chamber 44, when the spool 32 is at the non-active position as indicated in FIG. 1. If the spool 32 is activated owing to a differential pressure between before and after the metering orifice, the first fluid pressure chamber 14 is steadily blocked from the pump suction-side chamber 44, and is caused to communicate with the high pressure chamber 40. Accordingly, a pressure $P_0$ on the high pressure chamber 40 or a pressure $P_1$ upstream of the metering orifice provided within the pump discharge-side passage is selectively supplied to the first fluid pressure chamber 14.

Also, the second fluid pressure chamber 16 provided to the right of the cam ring 10 is connected via the connection passages 2*b* and 6*b* to the spring chamber 34, when the spool 32 is in the non-active state. If the spool 32 is activated, the second fluid pressure chamber 16 is steadily blocked from the spring chamber 34, and is gradually caused to communicate with the pump suction-side chamber 44. Accordingly, a pressure $P_2$ downstream of the metering orifice or a pressure $P_0$ on the pump suction side is selectively supplied to the second fluid pressure chamber 16.

A relief valve 46 is provided inside the spool 32, and if the pressure within the spring chamber 34 (i.e., pressure downstream of the metering orifice, in other words, working pressure of the power steering apparatus) is increased beyond a predetermined value, the relief valve 46 is opened to allow this fluid pressure to escape into the tank.

The constitution and operation of the variable displacement pump 1 are substantially the same as conventionally known, and are only shown partly and not described in detail. Moreover, the variable displacement pump 1 according to the embodiment of the invention is provided with a piston as thrust applying means to press on the spool 32 of the control valve 28 with a working pressure (load pressure) of the power steering apparatus to increase the pump discharge flow.

An annular holding member 50 is fitted firmly on the bottom (end portion of the spring chamber 34) of the valve bore 30 into which the spool 32 of the control valve 28 is fitted slidably (see FIG. 1, but omitted in FIG. 2 that shows only the simplified structure). A seal member 52 is covered around the outer periphery of the annular holding member 50 to demarcate a space 54 between the spring chamber 34 and the bottom of the valve bore 30 (on the right end side of FIG. 1) with the liquid tightness maintained.

A internal bore 56 formed through an axial center of the annular holding member 54 is composed of a larger diameter bore 56*a* on the bottom of the valve bore 30 and a small diameter bore 56*b* on the side of the spring chamber 34, in which a stepped piston 58 is fitted within the internal bore 56. A larger diameter portion 58*a* of the stepped piston 58 is fitted slidably into the larger diameter bore 56*a* of the internal bore 56, and a small diameter portion 58*b* is fitted slidably into the small diameter bore 56*b*. Moreover, a fine diameter portion 58*c* formed at the top end of the small diameter portion 58*b* for the stepped piston 58 projects from the internal bore 56 of the annular holding member 50 into the spring chamber 34.

A spring accepting ring 60 is fitted into the fine diameter portion 58*c* at the top end of the stepped piston 58 to support one end of the spring 36 that biases the spool 32 of the control valve 28 toward the high pressure chamber 40. The spring accepting ring 60 is pressed by the spring 36 and engages a step portion between the small diameter portion 58*b* of the stepped piston 58 and the fine diameter portion 58*c* at the top.

The stepped piston 58 is formed with a passage bore 62 passing through the axial center, and a pressure within the spring chamber 34, namely, a pressure on the pump discharge side downstream from the metering orifice is introduced via this passage bore 62 into the space 54 behind the large diameter portion 58*a* of the stepped piston 58 (or space at the right end in the figure). Also, a space 63 delineated by the step portion between the large diameter portion 58*a* and the small diameter portion 58*b* of the stepped piston 58 and the inner face of the large diameter bore 56*a* for the annular holding member 50 is connected via a passage 64 (see FIG. 2) within the valve body 2 to the tank. A pressure introduced into the space 63 is not limited to the tank pressure, but may be lower than the pressure downstream of the metering orifice.

The stepped piston 58 has an equal fluid pressure (fluid pressure downstream of the metering orifice, namely, working pressure of the power steering apparatus) acting on both end faces, and if this working pressure is increased beyond a predetermined value, the piston 58 is moved to the left in the figure by flexing the spring 36 due to a difference in the pressure receiving area between the large diameter portion 58*a* and the small diameter portion 58*b*. The piston 58 is stopped when an end face of the large diameter portion 58*a* close to the small diameter portion 58*b* (i.e., an end face to the left in the figure) abuts against a step portion 56*c* (stopper face) between the large diameter portion 56*a* and the small diameter portion 56*b* for the annular holding member 56. In this embodiment, the spring force of the spring 36 is set such that the piston 58 can not be moved till the working pressure of the power steering apparatus reaches, for example, 0.6 Mpa.

The control valve 28 makes only a small difference in the fluid pressure between the upstream and downstream sides of the metering orifice directly after the variable displacement pump 1 starts, so that the spool 32 is stopped due to a force of the spring 36 at a position indicated in FIG. 1. Accordingly, the tank pressure $P_0$ is introduced into the first fluid pressure chamber 14 connected to the pump suction-side chamber 44, and the pressure $P_2$ downstream of the metering orifice is introduced into the second fluid pressure chamber 16 via the spring chamber 34, whereby the cam ring 10 is pressed to the left in FIG. 1 so that the volume of the pump chamber 24 is at maximum.

And when the engine rotation number is higher, the discharge flow from the pump chamber 24 is gradually increased, so that there occurs a more difference in pressure (differential pressure) between the upstream and downstream sides of the metering orifice. If a predetermined differential pressure is reached, the spool 32 is moved in a direction of flexing the spring 36 (toward the spring chamber 34), balanced at a predefined position, and maintained in this state (state shown in FIG. 2). At this time, the spool 32 is almost stabilized in a condition where the pump suction side is connected or connectable to the first fluid pressure chamber 14 and the second fluid pressure chamber 16 formed on both sides of the cam ring 10.

Figure 6:
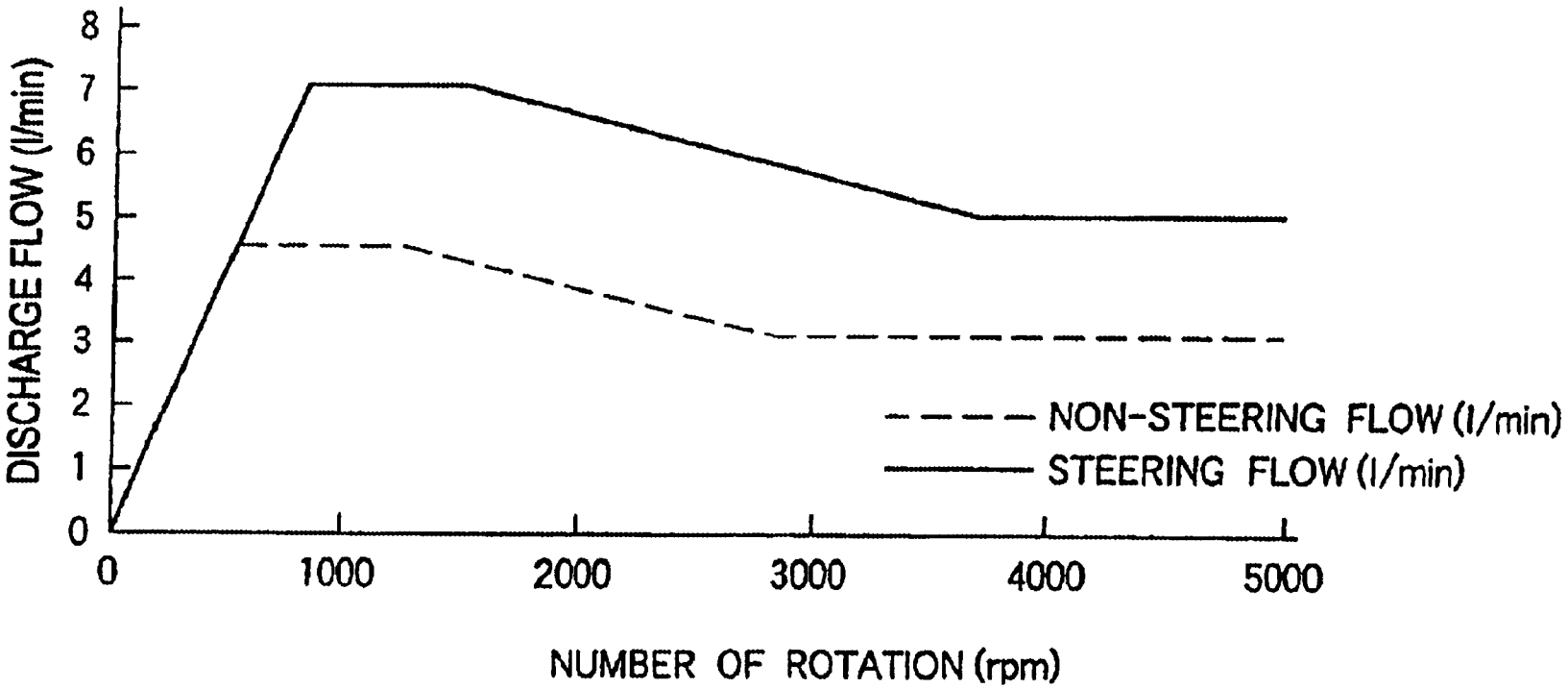
FIG. 6 is a diagram showing the flow characteristic of the variable displacement pump.

In such an equilibrium state of the spool 32, the cam ring 10 is swung to the right in FIG. 1, due to a differential pressure between the fluid pressure chambers 14 and 16 on both sides and a biasing force of the compression coil spring 26, and balanced at a position at which the pump chamber 24 has the minimum displacement of the pump. In this condition, the pump has the minimum pump discharge flow, in which the discharge flow is 4.51/min in this embodiment (as seen by the broken line in FIG. 6). The numerical value of this discharge flow is one example, and can be appropriately set by the contracted amount of the metering orifice or the volume of the pump chamber 24 from the minimum steering auxiliary force as needed.

Also, if the steering operation is performed in the equilibrium state as above cited, the working pressure of the power steering apparatus is increased, and if it is beyond a predetermined value, the piston 58 is moved to the left in the figure by flexing the spring 36 owing to a difference in the area between the large diameter portion 58*a* and the small diameter portion 58*b* of the stepped piston 58 on which this working pressure is applied. If the piston 58 is moved, the spool 32 is subjected to an axial thrust is applied via the flexed spring 36 and moved to the left in the figure in accordance with this thrust.

When the spool 32 is moved, the first fluid pressure chamber 14 is connected to the pump suction-side chamber 44, and the second fluid pressure chamber 16 is connected to the spring chamber 34 into which the pressure downstream of the metering orifice is introduced. Thereby, the cam ring 10 is swung to the left in FIG. 1 to expand the volume of the pump chamber 24. Accordingly, the discharge flow from the pump is increased. The solid line of FIG. 6 indicates one example of the discharge flow, with the maximum flow (71/min in this example) needed at the time of steep steering.

If the working pressure of the power steering apparatus is further increased, the stepped piston 58 is stopped when the front face (i.e., end face to the left in the figure) of the large diameter portion 58*a* abuts against the stop face 56*c* of the annular holding member 50, so that no more thrust of the piston 58 is passed to the spool 32. In this embodiment, if the working pressure of the power steering apparatus reaches, for example, 1.5 Mpa, the piston is stopped in the setting.

If the above flow characteristic is controlled to be attained, the spool 32 of the control valve 28 is moved to become closer to the minimum flow (e.g., 4.51/min) defined for the metering orifice and maintained in this condition during the non-steering. And since the spool 32 is maintained in the equilibrium state with the minimum flow during this non-steering, the differential pressure at the metering orifice can be set small. For example, the differential pressure at the metering orifice was conventionally 0.2 Mpa in the equilibrium state, but can be set as small as about 0.07 MPa in this invention. Accordingly, the pressure loss of this metering orifice is reduced.

On one hand, at the time of steering, the spool 32 is moved in a moment from the equilibrium state in FIG. 2 to the left in the same figure owing to a thrust caused in the piston 58 in response to the working pressure of the power steering apparatus. Thereby, the fluid pressure within the first and second fluid pressure chambers 14 and 16 is controlled to increase rapidly the pump discharge flow to a predetermined value, producing a required steering auxiliary force. Accordingly, a required steering force is produced without giving rise to a response delay, even at the time of steep steering, whereby the performance of the power steering apparatus can be kept.

As described above, while the vehicle is running straight, the spool 32 of the control valve 28 is controlled only by a force of the spring 36, and when the power steering apparatus is operated, its working pressure (load pressure), instead of the thrust of the piston 58, is exerted to press the spool 32 to increase the pump discharge flow. Accordingly, the differential pressure between the upstream and downstream pressures of the metering orifice is only low while the vehicle is running straight, because it is only necessary to withstand the force of the spring 36, but at the time of steering, the force of the spring 36 and the pressing force of the piston 58 are applied simultaneously in the conventional manner, whereby the remarkable energy saving effect can be obtained while the vehicle is running straight.

Figure 3:
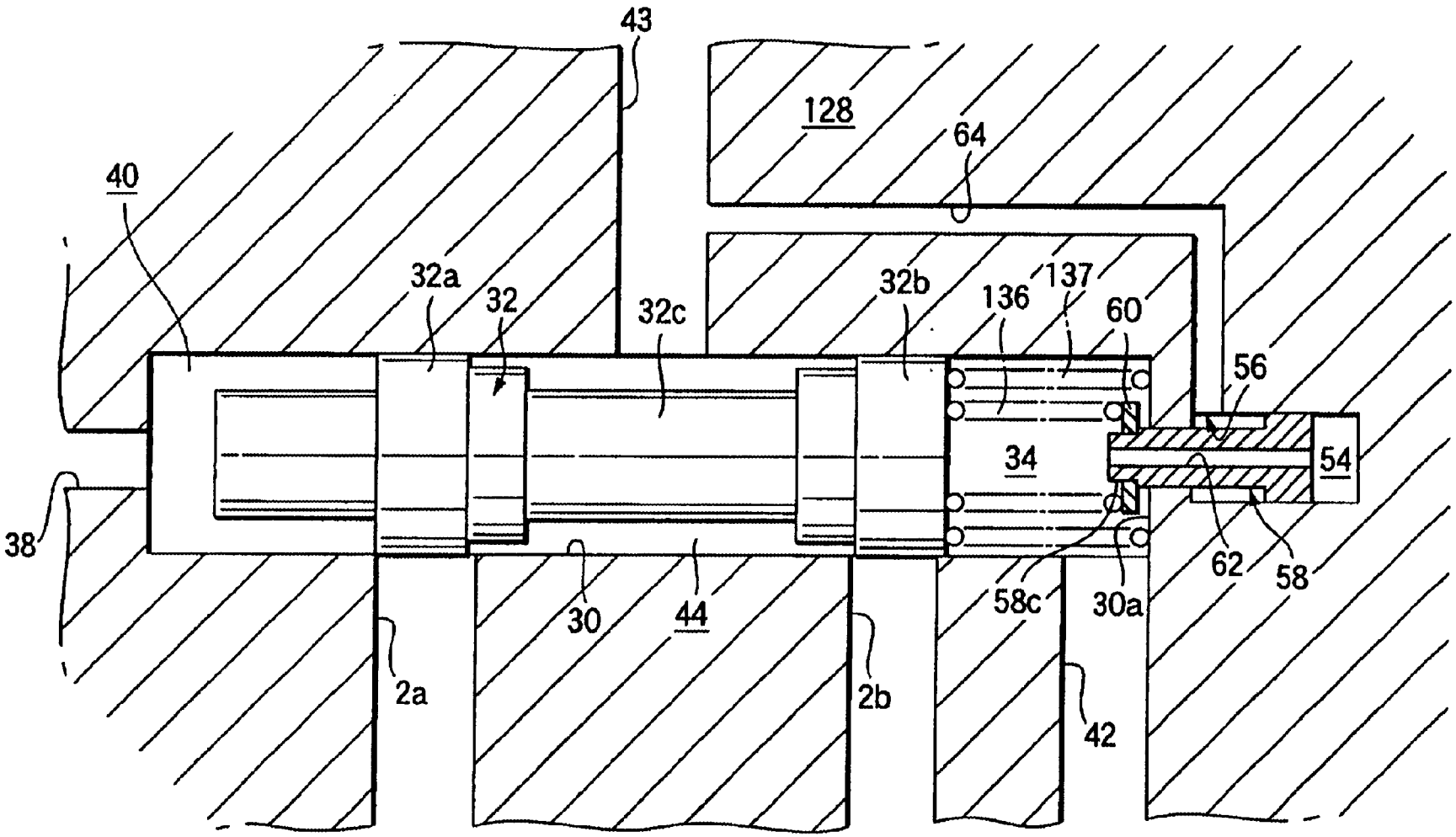
FIG. 3 is a schematic structure view showing a control valve of a variable displacement pump according to a second embodiment of the invention in simplified form.

FIG. 3 is a view showing a control valve 128 for the variable displacement pump 1 according to the second embodiment of the invention. The basic constitution of the control valve 128 is the same as that of the control valve 28 in the first embodiment, in which the same or like parts are designated by the same reference numerals and not described here, and different parts are only set forth below. FIG. 3 shows a balanced state where the spool 32 has been moved owing to a differential pressure between the upstream and downstream sides of the metering orifice in the same manner as in FIG. 2.

In the first embodiment, one end of the spring 36 (left end in FIGS. 1 and 2) is contacted with an end face of the spool 32, and the other end is contacted with the spring accepting ring 60 engaged in the step portion between the small diameter portion 58*b* and the top end fine diameter portion 58*c* of the stepped piston 58. However, in this second embodiment, inner and outer duplicate springs 136 and 137 are disposed within the spring chamber 34. An inner spring 136 has one end (left end in FIG. 3) contacted with the end face of the spool 32, and the other end contacted with the spring accepting ring 60 engaged in the stepped piston 58 in the same manner as the spring 36 of the first embodiment. Also, an outer spring 137 has one end (left end in FIG. 3) contacted with the end face of the spool 32, and the other end contacted with a bottom face 30*a* of the valve bore 30 (or its side face when the annular holding member SO is disposed as shown in FIG. 1) formed in the valve body.

The outer spring 137 has a low spring constant so that the set load can be less dispersed even when the set length is varied, whereby the dispersion in the flow during the non-steering or in its turn the dispersion in the differential pressure of the metering orifice can be suppressed. Also, the inner spring 136 has such a spring constant that the piston 58 is moved a predetermined displacement when the fluid pressure on the side of the power steering apparatus is increased at the time of steering and reaches a predetermined value. Other constitution is the same as in the first embodiment.

In this embodiment, the operation is made in the same manner as in the first embodiment, exhibiting the same effect. Moreover, in the first embodiment, the single spring 36 has the function of setting the differential pressure between before and after the metering orifice activating the spool 32, as well as transmitting the thrust of the piston 58 being moved due to working pressure of the power steering apparatus to the spool 32, whereby it is required that the set load of this spring 36 is highly precise, although the set load for the springs 136 and 137 is not required to be very highly precise in this embodiment.

Figure 4:
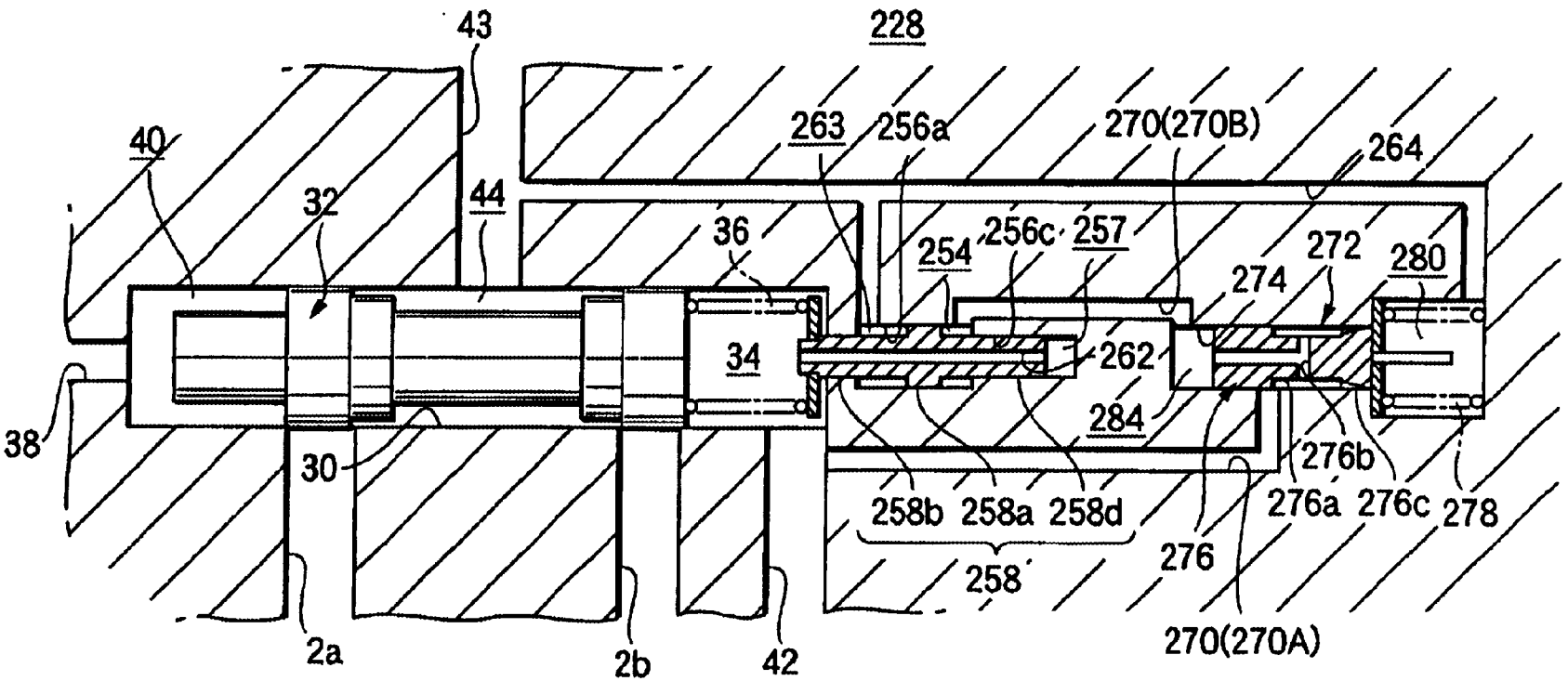
FIG. 4 is a schematic structure view showing a control valve of a variable displacement pump according to a third embodiment of the invention in simplified form.

FIG. 4 is a view showing a control valve 228 of the variable displacement pump 1 according to the third embodiment of the invention. This control valve 228 has the same constitution as in the first embodiment, except for a piston 258 applying an axial thrust to the spool 32 of the control valve 228.

The piston 258 of this third embodiment has a stepped piston 258 having a large diameter portion 258*a* and a small diameter portion 258*b* which is constituted in the same manner as the stepped piston 58 in the first and second embodiments, with a small diameter portion 258*d* having an equal diameter to that of the small diameter portion 258*b* on the side of the spring chamber 34 being formed behind the stepped piston 258 (to the right in FIG. 4), in which the backward small diameter portion 258*d* is fitted slidably in a small diameter bore 256*c* continuous from a large diameter bore 256*a* formed in the valve body 2.

A through bore 262 is formed through the axial center of this piston 258 and communicates between the spring chamber 34 and a space 257 on the bottom portion of the small diameter bore 256*c* into which the backward small diameter portion 258*d* is fitted, whereby the pressure within the spring chamber 34 or the pressure downstream of the metering orifice is introduced into the bottom space 257. In this manner, the piston 258 does not produce any thrust to press the spring 36 due to variations in the working pressure of the power steering apparatus by applying the same pressure on both ends of the piston 258.

The fluid pressure on the side of the power steering apparatus is introduced via an introduction passage 270 into a space (hereinafter referred to as a pressure chamber) 254 around a step portion between the large diameter portion 258*a* formed centrally in the stepped piston 258 and the backward small diameter portion 258*d*. And the fluid pressure on the side of the tank is introduced into a space around the step portion between the large diameter portion 258*a* and the forward small diameter portion 258*b*.

A change-over valve 272 is provided halfway on the introduction passage 270. This change-over valve 272 comprises a spool valve disc 276 fitted slidably in a valve hole 274 formed in the valve body 2 and a spring 278 for biasing the spool valve disc 276. A chamber for accommodating the spring 278 is connected via a passage 264 to the tank. A chamber 284 on the opposite end side (left in FIG. 4) of the chamber 280 for accommodating the spring 278 within the valve hole 274 is connected via a downstream portion 270B of the introduction passage 270 to the pressure chamber 254 behind the piston large diameter portion 258*a*. A V-shaped notch 276*c* is formed at a land portion of the chamber 280 that accommodates the spring 278 of the spool valve disc 276.

An annular groove 276*a* is formed intermediately around the outer periphery of the spool valve disc 276 in the change-over valve 272, in which this annular groove 276*a* communicates with an end chamber 284 connected to the pressure chamber 254 via an internal passage 276*b*. Accordingly, when the spool valve disc 276 is pressed by the spring 278 and stopped in a non-active position, as shown in FIG. 4, the fluid pressure on the side of the power steering apparatus that is introduced via the introduction passage 270 (its upstream portion 270A) is introduced via the annular groove 276*a* of the spool valve disc 276, the internal passage 276*b*, the end chamber 284 and the downstream portion 270B of the introduction passage 270 into the pressure chamber 254 backward of the piston large diameter portion 258*a*.

Also, if the working pressure of the power steering apparatus is increased beyond a predetermined value, the spool valve disc 276 is moved to the right in FIG. 4 by flexing the spring 278, so that the annular groove 276*a* is blocked from the upstream portion 270A of the introduction passage 270, and the pressure in the end chamber 284 is released from the V-notch 276*c* toward the chamber 280 accommodating the spring 278. Since the fluid pressure utilization equipment has some pressure loss due to piping resistance at the time of having no load, and a pressure loss of about 0.3 MPa in this power steering apparatus, the force of the spring 280 is set up so that the spool valve disc 276 is not activated till the working pressure of the power steering apparatus is, for example, 0.5 Mpa in this embodiment, In this embodiment, if the pump rotation number is increased to produce a larger difference between the pressures before and after the metering orifice during the non-steering, the spool 32 is moved to the right in the figure by flexing the spring 36, resulting in the balanced state in the same manner as in the first embodiment and as previously described.

If the steering operation is performed in this state, the pressure on the side of the power steering apparatus is increased. The working pressure on the side of the power steering apparatus is introduced from the pilot passage 42 into the spring chamber 34 at the right end of the spool 32, as well as via the internal passage 276*b*, the end chamber 284 of the valve bore 274 and the downstream portion 270B of the introduction passage 270 into the pressure chamber 254 formed behind the large diameter portion 258*a* of the piston 258. If the working pressure of the power steering apparatus is increased beyond a predetermined value, the piston 258 is moved to the left due to a difference in the pressure receiving area between the large diameter portion 258*a* and the small diameter portion 258*b* of the piston 258 on which this pressure is exerted. If the piston 258 is moved, an axial thrust is applied on the spool 32 via the spring 36 which is flexed, so that the spool 32 is moved to the left in FIG. 4 in response to this thrust.

When the spool 32 is moved, the first fluid pressure chamber 14 is connected to the pump suction-side chamber 44, and the second fluid pressure chamber 16 is connected to the spring chamber 34 into which the pressure downstream of the metering orifice is introduced. Thereby, the cam ring 10 is swung to the left in FIG. 1 to expand the volume of the pump chamber 24. Accordingly, the discharge flow from the pump is increased.

As described above, in this embodiment, the operation is performed in the same manner as in the first embodiment, and the same effect can be exhibited. In the first embodiment, if the working pressure of the power steering apparatus is increased beyond a predetermined value, the piston 58 abuts against the stopper face 56*c* and is stopped not to apply more thrust on the spool 32, whereas in this embodiment, if the working pressure of the power steering apparatus is increased beyond a predetermined value, the spool valve disc 276 of the change-over valve 272 is activated so that the introduction passage 270 into the pressure chamber 254 behind the piston 258 is blocked and the pressure in the pressure chamber 254 and the end chamber 284 of the change-over valve 272 is released from the V-notch 276*c* toward the chamber 280 accommodating the spring 278 to maintain the pressure in the pressure chamber 254 in a predetermined value. Accordingly the piston is kept from being moved, thereby limiting the thrust transmitted to the spool.

Figure 5:
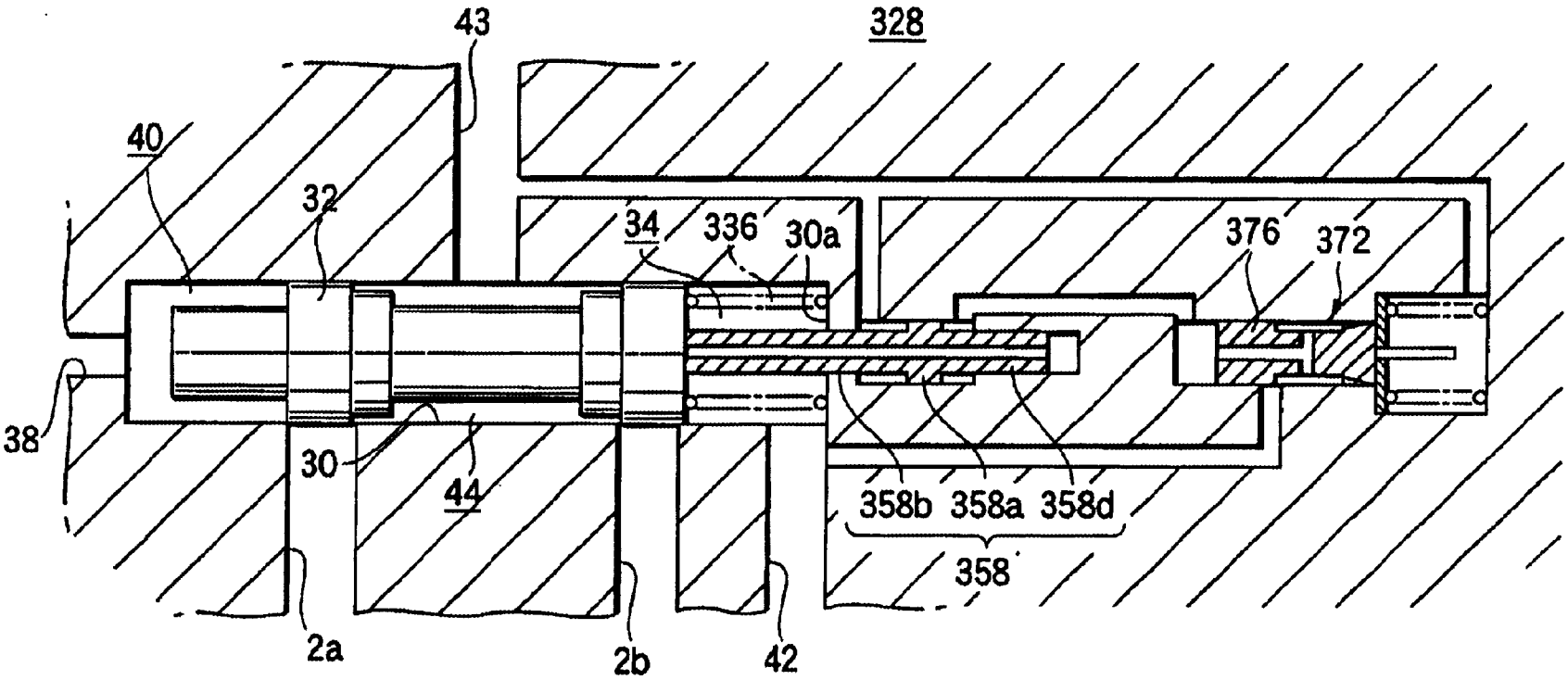
FIG. 5 is a schematic structure view showing a control valve of a variable displacement pump according to a fourth embodiment of the invention in simplified form.

FIG. 5 is a view showing a control valve 328 of the variable displacement pump 1 according to the fourth embodiment of the invention. In this fourth embodiment, the constitution of a piston 358 is different from that of the third embodiment. The piston 358 of this fourth embodiment has a small diameter portion 358*b* on the side of the spool 32 extended into the inside of the valve bore 30. If the spool 32 of the control valve 328 is activated owing to a differential pressure across the metering orifice, resulting in an equilibrium state (state as shown in FIG. 5), an end face of the spool 32 on the side of a spring 336 is confronted with a top end face of the small diameter portion 358*b* for the piston 358 in almost contact state. Also, an end portion of the spring 336 that biases the spool 32 of the control valve 328 on the side of the piston 358 is not engaged with the piston 358, but contacted with the bottom face 30*a* of the valve bore 30. Other constitution is the same as in the third embodiment, and not described here.

In this fourth embodiment, if the vehicle is steered from the equilibrium state (state of FIG. 5) of the spool 32, and the working pressure of the power steering apparatus is increased to move the piston 358 to the left, the thrust is not applied via the springs 36 and 136 as in the above embodiments, but the piston 358 directly presses the spool 32 and moves it to the left in FIG. 5.

In this fourth embodiment, the operation is performed in the same manner as in the above embodiments, resulting in the same effect. Moreover, the spring 336 biasing the spool 32 has a low spring constant, so that the dispersed flow during the non-steering can be suppressed even when the set length is varied. Also, the piston 358 directly presses the spool 32, but not via the spring 336, the control valve can be switched swiftly and surely at the time of steering, and the discharge flow of the pump increased.

The present invention is not limited to the above embodiments, but may be modified or changed appropriately in the shape and structure of each part. In the above embodiments, the variable displacement pump used as the hydraulic source of the power steering apparatus mounted on the vehicle is described, but the invention is not limited to the variable displacement pump, but maybe appropriately applied to any other pump so far as it can assure the reliable operation on the side of the pressure fluid utilization equipment by increasing or decreasing the supply flow from the pump, as needed, while attaining the energy saving effect by reducing the pump power.

As described above, according to the present invention, the variable displacement pump has the piston that is moved in accordance with an increase in working pressure of the pressure fluid utilization equipment, in which this piston exerts an axial thrust to an end face of the spool in the control valve on the spring side, whereby there is the energy saving effect by reducing the pump driving torque while the vehicle is running straight.

What is claimed is:

1. A variable displacement pump comprising:

a pump body having an inner space;

a cam ring supported slidably in the inner space of the pump body, the cam ring defines;

a first fluid pressure chamber on one side of the cam ring; and a second fluid pressure chamber on the other side thereof;

a rotor disposed rotatably within the cam ring;

a biasing member for biasing the cam ring in a direction where the pump displacement of a pump chamber is at maximum;

a metering orifice provided halfway on a discharge passage for supplying a pressure fluid discharged from the pump chamber to an pressure fluid utilization equipment; and a control valve for applying an upstream fluid pressure and a downstream fluid pressure of the metering orifice on both end faces of a spool, the control valve having a spring disposed on an end face side on which the downstream fluid pressure is applied; and a piston provided to apply in axial thrust to an end face of the spool on the spring side, the piston moved with an increase in working pressure of the pressure fluid utilization equipment, wherein the cam ring is swung by controlling at least one fluid pressure of the fluid pressure chamber through activation of the control valve.

2. The variable displacement pump according to claim 1, wherein the piston is a stepped piston disposed on the opposite side of the spool, with the spring interposed;

one end of the spring is contacted with a small diameter end of the piston;

a working pressure of the pressure fluid utilization equipment is applied on a large diameter end of the piston;

an axial thrust is applied via the spring to the spool of the control valve by introducing a lower pressure than the downstream fluid pressure of the metering orifice into a space formed around a step portion between a small diameter portion and a large diameter portion of the piston; and the piston is moved by a working pressure of the fluid pressure utilization equipment.

3. The variable displacement pump according to claim 2, wherein a second spring is disposed around the outer periphery of the spring;

one end of the second spring is contacted with an end face of the spool; and the other end thereof is contacted with an end face of a valve bore.

4. The variable displacement pump according to claim 1, wherein the piston is a stepped piston disposed on the opposite side of the spool, with the spring interposed;

a working pressure of the pressure fluid utilization equipment is applied on a large diameter end of the piston;

a small diameter end thereof is extended to the spool side; and when the piston is moved by a working pressure of the fluid pressure utilization equipment, an axial thrust is applied with a small diameter end of the piston directly contacted with the spool.

5. The variable displacement pump according to claim 2, wherein a change-over valve is provided halfway on an introduction passage for introducing a working pressure of the fluid pressure utilization equipment to a large diameter end of the piston; and when the working pressure is increased above a predetermined value, the change-over valve shuts off the introduction passage.

6. The variable displacement pump according to claim 4, wherein a change-over valve is provided halfway on an introduction passage for introducing a working pressure of the fluid pressure utilization equipment to a large diameter end of the piston; and when the working pressure is increased above a predetermined value, the change-over valve shuts off the introduction passage.

7. The variable displacement pump according to claim 1, wherein the piston applies in the axial thrust to the end face of the spool on the spring side so that an eccentricity amount of the cam ring increases with the increase in the working pressure.

* * * * *